US011320100B2

(12) United States Patent
Lambooij et al.

(10) Patent No.: US 11,320,100 B2
(45) Date of Patent: May 3, 2022

(54) CRISP WHITE TUNING

(71) Applicant: SIGNIFY HOLDING B.V., Eindhoven (NL)

(72) Inventors: Marcus Theodorus Maria Lambooij, Eindhoven (NL); Martinus Petrus Joseph Peeters, Weert (NL); Tobias Borra, Rijswijk (NL); Dragan Sekulovski, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/296,898

(22) PCT Filed: Nov. 29, 2019

(86) PCT No.: PCT/EP2019/083021
§ 371 (c)(1),
(2) Date: May 25, 2021

(87) PCT Pub. No.: WO2020/114894
PCT Pub. Date: Jun. 11, 2020

(65) Prior Publication Data

US 2022/0034457 A1 Feb. 3, 2022

(30) Foreign Application Priority Data

Dec. 4, 2018 (EP) ..... 18209982

(51) Int. Cl.
*F21K 9/64* (2016.01)
*F21K 9/69* (2016.01)
(Continued)

(52) U.S. Cl.
CPC ..... *F21K 9/64* (2016.08); *F21K 9/69* (2016.08); *F21V 9/38* (2018.02); *F21Y 2113/13* (2016.08); *F21Y 2115/10* (2016.08)

(58) Field of Classification Search
CPC ..... F21K 9/00; F21K 9/64; F21K 9/69; G02B 6/0068; F21Y 2115/10; F21Y 2113/13; F21V 9/38
See application file for complete search history.

(56) References Cited

U.S. PATENT DOCUMENTS 9,888,537 B2 2/2018 Lee et al.
2004/0104391 A1* 6/2004 Maeda ..... C09K 11/025 257/79
(Continued)

FOREIGN PATENT DOCUMENTS

EP 2892306 A1 7/2015
EP 3382755 A1 10/2018
(Continued)

*Primary Examiner* — William J Carter
(74) *Attorney, Agent, or Firm* — Daniel J. Piotrowski

(57) ABSTRACT

The invention provides a lighting system (1000) configured to provide lighting system light (1001), the lighting system (1000) comprising: —a first light source (10) configured to generate first light source light (11) having an emission band with a peak wavelength selected from the range of 380-420 nm; —a second light source (20) configured to generate second light source light (21), spectrally different from the first light source light (11), having an emission band with a peak wavelength selected from the range of 425-440 nm; —a third light source (30) configured to generate third light source light (31), spectrally different from the first light source light (11) and from the second light source light (21), having an emission band with a peak wavelength selected from the range of 445-465 nm; —a luminescent material (200) configured to convert part of one or more of the first light source light (11), the second light source light (21), the third light source light (31), and optional fourth light source light (41) of an optional fourth light source (40), into luminescent material light (201) having an emission with one or more emission wavelengths selected from the range of 530-700 nm; and —a control system (160) configured to control the lighting system light (1001), wherein the lighting system light (1001) comprises one or more of the first light source light (11), the second light source light (21), the third light source light (31), and the luminescent material light (201).

15 Claims, 2 Drawing Sheets

(51) Int. Cl.

| | |
|---|---|
| ***F21V 9/38*** | (2018.01) |
| ***F21Y 113/13*** | (2016.01) |
| ***F21Y 115/10*** | (2016.01) |

(56) References Cited

U.S. PATENT DOCUMENTS

| | | | | |
|---|---|---|---|---|
| 2009/0224652 | A1* | 9/2009 | Li | C09K 11/7733 313/498 |
| 2014/0055982 | A1* | 2/2014 | Tao | C09K 11/7733 362/84 |
| 2015/0062892 | A1* | 3/2015 | Krames | F21V 19/006 362/231 |
| 2015/0263240 | A1* | 9/2015 | Tomizawa | G01J 3/0251 362/84 |
| 2017/0111972 | A1 | 4/2017 | Oepts et al. | |
| 2018/0056027 | A1 | 3/2018 | Peeters et al. | |
| 2018/0073712 | A1 | 3/2018 | Baaijens et al. | |
| 2019/0139943 | A1* | 5/2019 | Tiwari | H01L 25/0753 |
| 2019/0341531 | A1* | 11/2019 | Zhang | H01L 33/504 |

FOREIGN PATENT DOCUMENTS

| | | | |
|---|---|---|---|
| WO | 2015066099 | A2 | 5/2015 |
| WO | 2017021087 | A1 | 2/2017 |

* cited by examiner

CRISP WHITE TUNING

CROSS-REFERENCE TO PRIOR APPLICATIONS

This application is the U.S. National Phase application under 35 U.S.C. § 371 of International Application No. PCT/EP2019/083021, filed on Nov. 29, 2019, which claims the benefit of European Patent Application No. 18209982.0, filed on Dec. 4, 2018. These applications are hereby incorporated by reference herein.

FIELD OF THE INVENTION

The invention relates to a lighting system and to a lighting device that may e.g. be used in such system.

BACKGROUND OF THE INVENTION

Lamps with brightening effects are known in the art. WO2015/066099, for instance, describes a light source comprising at least one solid state light emitter. The light source, in operation, emits substantially white light having a Lighting Preference Index (LPI) of at least about 105, and this emission from the light source comprises a UV-violet flux of at least about 1%. Use of the lamps, light sources, and methods of the present disclosure may afford the ability to display linens and clothing under energy-efficient LED-based illumination, and may impart an effect to (especially white) clothing, that makes them look cleaner than under illumination by prior art LED lamps. The UV-violet flux is at most about 30%.

SUMMARY OF THE INVENTION

Light sources or illumination devices consisting of light emitting diodes (LEDs) are increasingly used for replacing conventional light sources such as incandescent lamps and fluorescent light sources. LEDs offer many advantages compared to conventional light sources, especially when it comes to light conversion efficiency. However, one disadvantage is that LEDs generate light in a relatively narrow spectral band.

In many applications, such as retail applications and retail environments, the standard with respect to for example color rendition is set by light sources such as the Philips CDM-Elite. The CDM-Elite lamp has high quality of light and an excellent white rendition. The term "white rendition" refers to a desired improved white appearance of a white object being illuminated by a light source. When LED-based light sources are used to replace traditional lighting systems, they are especially required to generate light that is perceived as white.

Color reproduction is typically measured using the color rendering index (CRI), which is calculated in Ra. The CRI is sometimes also referred to as color rendition index. The CRI is a quantitative measure of the ability of a light source to reproduce the colors of various objects faithfully in comparison with an ideal or natural light source. Daylight has a high CRI, where Ra is approximately 100. Incandescent bulbs are relatively close with a Ra greater than 95 and fluorescent lighting is less accurate with a Ra of typically 70-90.

Consequently, in order to achieve the desired "white" light in LED-based lighting applications, light sources with a high CRI are desirable. For LED lighting systems there are warm-white or neutral-white LED modules with a color rendering of about 80-90 readily available. Although the color rendition of these sources is good, white objects viewed under these light sources appear somewhat less white compared to some alternatives. In some applications, this may be a disadvantage for these LED modules, especially for the mentioned retail applications where lamps having excellent white rendition, often referred to as "crisp white", are preferred.

A light source comprising multiple channels, for instance red, green, blue and white (RGBW) allows for color point variation. In addition, the color rendering properties of a source can be adjusted.

Proper textile enhancement, or enhancement of other articles, such as food, appears to be a relevant factor in retail. To this end, it is desirable to enable lighting solutions that allow enhancement of color appearance of fabrics, or other articles. Presently, there are some lighting systems, which, relative to other lighting systems, allow providing crisp white light. However, this crisp effect is fixed. This may however be undesirable.

Hence, it is an aspect of the invention to provide an alternative lighting system and/or lighting device, which preferably further at least partly obviate(s) one or more of above-described drawbacks. In particular, it is an object of the present invention to provide a lighting system and/or lighting device which can generate light having an excellent white rendering, and which can produce a so called "crisp white" effect, which gives the option to tune the color point, but which is also a relatively simple system (and/or lighting device) with limited number of channels.

Especially, for spot lighting sources the number of channels should be as small as possible to minimize problems with color mixing and optimize brightness of the source. In addition, minimizing the number of channels saves cost and size of both the light source and the driver. Violet LEDs appear to be useful to create crisp white, whereas blue LEDs are useful to create a sufficiently large CCT range. The use of both types of blue LEDs in a single source may create or aggravate problems with color mixing, may diminish source brightness and may increase driver complexity. It appears that in a relatively elegant way with a minimum number of channels the above defined problems may be solved.

In embodiments, it is herein amongst others proposed to use 380-420 nm LEDs, 425-440 nm LEDs, and 445-465 nm LEDs, in combination with other sources of light to provide (amongst others) white light. In these ways both crisp white light may be provided, with controllable lighting properties, to such an extent that e.g. over a predetermined range the crisp aspect of the light may be tuned, while other lighting properties, such as one or more of color point, correlated color temperature, and color rendering index may be kept essentially constant.

Hence, in a first aspect the invention provides a lighting system ("system") configured to provide lighting system light, the lighting system comprising:

a first light source configured to generate first light source light having an emission band with a peak wavelength, especially selected from the range of 380-420 nm;

a second light source configured to generate second light source light, spectrally different from the first light source light, having an emission band with a peak wavelength especially selected from the range of 425-440 nm;

a third light source configured to generate third light source light, spectrally different from the first light source light and from the second light source light, having an emission band with a peak wavelength especially selected from the range of 445-465 nm;

a luminescent material configured to convert part of one or more of the first light source light, the second light source light, the third light source light, and optional fourth light source light of an optional fourth light source, into luminescent material light having an emission with one or more emission wavelengths selected from the range of 530-700 nm; and a control system configured to control the lighting system light, wherein the lighting system light comprises one or more of the first light source light, the second light source light, the third light source light, and the luminescent material light.

With such system, it is possible to provide white light with a relatively high CRI but also having a crisp white light effect. Further, it is possible to tune the color temperature and/or CRI and the extent of the crisp effect, while using a relatively simple system. The electronics can be compact, allowing the system to be incorporated in e.g. a spotlight. Further, with such system it is possible to vary the crisp aspect of the light, while other lighting properties, such as one or more of color point, correlated color temperature, and color rendering index, may be kept essentially constant. Other options may also be possible, such as varying one of the other lighting parameters and keeping one or more or of the other lighting parameters essentially constant.

In embodiments, the lighting system comprises a lighting device comprising the first light source, the second light source, the third light source, the luminescent material, and optionally the optional fourth light source. The lighting device may especially be a spotlight device (or "spotlight"). In yet a further aspect, the invention also provides such lighting device configured to provide lighting device light, the lighting device comprising:

a first light source configured to generate first light source light having an emission band with a peak wavelength, especially selected from the range of 380-420 nm;

a second light source configured to generate second light source light, spectrally different from the first light source light, having an emission band with a peak wavelength, specially selected from the range of 425-440 nm;

a third light source configured to generate third light source light, spectrally different from the first light source light and from the second light source light, having an emission band with a peak wavelength, specially selected from the range of 445-465 nm;

a luminescent material configured to convert part of one or more of the first light source light, the second light source light, the third light source light, and optional fourth light source light of an optional fourth light source, into luminescent material light having an emission with one or more emission wavelengths selected from the range of 530-700 nm.

Optionally, the lighting device further comprises an optical element configured to shape a beam of lighting device light having a beam angle ($\alpha$) selected from the range of 5-60°, such as 5-40°, wherein the lighting device light comprises one or more of the first light source light, the second light source light, the third light source light, and the luminescent material light.

Such lighting device may be comprised by the lighting system. In specific embodiments, the lighting system may be configured to provide the lighting system light as spotlight, with a relatively narrow beam. The lighting system may also be configured to provide a plurality of beams with such beam angles.

As indicated above, the invention provides a lighting system. In embodiments, the lighting system may comprise a lighting device, which lighting device comprises the herein described light sources. Such lighting device may also comprise the control system. Alternatively, the control system may be external from the lighting device(s), see further also below.

Irrespective of the configurations, of which some embodiments are further also elucidated below, the lighting system is especially configured to provide lighting system light. This lighting system light comprises light from one or more of the light sources of the lighting system. Especially, the spectral composition of the lighting system light is variable (by the control system). This may allow enhancing or decreasing the crisp effect, changing the color temperature, the color point and/or the color rendering index. In embodiments, it may be possible to vary one or more of these parameters while keeping one or more other parameters constant.

The lighting system comprises a first light source, a second light source, a third light source, and optionally a fourth light source. The listing of these light sources does not exclude the availability of other types of light sources. For instance, in specific embodiment the lighting system also comprises a fifth light source (see below). However, the number of types of light sources is limited, such as selected from the range of 3-10, like 3-6, like 3, 4 or 5. From each type of light sources, one or more may be available in the lighting system and/or lighting device. The term "light source" may thus in embodiments also refer to a plurality of specific types of light sources.

Hence, the term "first light source" may in embodiments also refer to a plurality of essentially identical first light sources, such as light sources from the same bin, or may in other embodiments be different in spectral output but all together generate the desired first light source light spectral power distribution.

Likewise, the term "second light source" may in embodiments also refer to a plurality of essentially identical second light sources, such as light sources from the same bin, or may in other embodiments be different in spectral output but all together generate the desired second light source light spectral power distribution.

Likewise, the term "third light source" may in embodiments also refer to a plurality of essentially identical third light sources, such as light sources from the same bin, or may in other embodiments be different in spectral output but all together generate the desired third light source light spectral power distribution.

Also, likewise, the term "fourth light source" may in embodiments also refer to a plurality of essentially identical fourth light sources, such as light sources from the same bin, or may in other embodiments be different in spectral output but all together generate the desired fourth light source light spectral power distribution.

Also, likewise, the term "fifth light source" may in embodiments also refer to a plurality of essentially identical fifth light sources, such as light sources from the same bin, or may in other embodiments be different in spectral output but all together generate the desired fifth light source light spectral power distribution.

Hence, the lighting system may comprise a plurality of light sources that are configured for providing in one or more operation modes of the system the lighting system light; however, there may be a limited set of types of light sources, such as four different types or five different types, see also below. The intensity of the different types of light of the different types of light sources may be controlled, in embodiments essentially independent of each other. For instance, it may in embodiments be possible to keep the intensity of the light of one of the (type of) light sources constant, while varying the intensity of the light of one or more of the other (types of) light sources. Hence, each (type of) light source may be functionally coupled to another driver channel. Especially, the lighting system light is controllable, implying that the spectral distribution of the system light can be controlled by controlling the intensity of the light source light of the first light source, the second light source and the third light source (and optionally further types of light sources).

Especially, the first light source is configured to generate first light source light having an emission band with a peak wavelength selected from the range of 380-420 nm. In embodiments, the first light source is configured to generate first light source light having an intensity averaged wavelength maximum selected from the range of 380-420 nm. The peak wavelength is the wavelength where the spectral power distribution of the light reaches its highest intensity. The first light source light may essentially consist of a single band, with a bandwidth equal to or smaller than about 50 nm. As indicated herein, the term "first light source" may also refer to a plurality of (different) first light sources.

Especially, the second light source is configured to generate second light source light having an emission band with a peak wavelength selected from the range of 425-440 nm. In embodiments, the second light source is configured to generate second light source light having an intensity averaged wavelength maximum selected from the range of 425-440 nm. The peak wavelength is the wavelength where the spectral power distribution of the light reaches its highest intensity. The second light source light may essentially consist of a single band, with a bandwidth equal to or smaller than about 50 nm. As indicated herein, the term "second light source" may also refer to a plurality of (different) second light sources.

Especially, the third light source is configured to generate third light source light having an emission band with a peak wavelength selected from the range of 445-465 nm. In embodiments, the third light source is configured to generate third light source light having an intensity averaged wavelength maximum selected from the range of 445-465 nm. The peak wavelength is the wavelength where the spectral power distribution of the light reaches its highest intensity. The third light source light may essentially consist of a single band, with a bandwidth equal to or smaller than about 50 nm. As indicated herein, the term "third light source" may also refer to a plurality of (different) third light sources.

Hence, there are at least three different types of light sources, which all have spectrally different emissions in the wavelength range of about 380-465 nm.

Further, especially, the light sources have intensity in the visible spectral range essentially only in the indicated wavelength ranges. Hence, in embodiments at least 50%, such as at least 60%, like at least 80%, of the spectral power in the visible (i.e. 380-780 nm) of the first light source light may be in the range of 425-440 nm. In embodiments, at least 50%, such as at least 60%, like at least 80%, of the spectral power in the visible of the second light source light may be in the range of 445-465 nm. In embodiments, at least 50%, such as at least 60%, like at least 80%, of the spectral power in the visible of the third light source light may be in the range of 445-465 nm. Further, in embodiments the peak wavelength emission maximum of the first light source may differ at least 10 nm from the second light source light, such as at least 15 nm. Further, in embodiments the peak wavelength emission maximum of the second light source may differ at least 10 nm from the third light source light. With respect to the luminescent material, when excited in the UV or blue, at least 50%, such as at least 60%, like at least 80%, of the spectral power of the luminescent material light in the visible (i.e. 380-780 nm) is within the range of 530-700 nm.

Hence, these three types of light sources may provide light in the UV/blue region. The terms "violet light" or "violet emission" and similar terms especially relates to light having a wavelength in the range of about 380-440 nm. The terms "blue light" or "blue emission" especially relates to light having a wavelength in the range of about 440-495 nm (including some violet and cyan hues).

To obtain white light one or more of the first light source light, the second light source light and the third light source light may (at least) partly be converted by a luminescent material. Alternatively or additionally, a fourth light source may be applied, which may provide the supplemental light to provide white light. Such fourth light source may comprise a solid state light source and one or more luminescent materials that provide green and/or red light based on a (partial) conversion of the solid state light source light (such as UV or blue light). Alternatively or additionally, solid state light sources may be provided that directly provide green or red light, such as green LED and/or a red LED (i.e. not based on phosphor conversion). Whatever solution is herein chosen, especially the lighting system (or lighting device) especially comprises a luminescent material for emission in the green (and optionally yellow) and/or in the red, especially at least in the green (and optionally yellow). The term "fourth light source" may also refer to a plurality of (different) fourth light sources. The term "luminescent material) may also refer to a plurality of different luminescent materials. The term "phosphor" and "luminescent material" herein refer to the same type of materials.

As it may be desirable to provide both (i) green (and/or yellow) light and (ii) red light with a luminescent materials, two different luminescent materials may be available, herein indicated as first luminescent material and second luminescent material. The term "first luminescent material" may also refer to a plurality of different first luminescent materials. The term "second luminescent material" may also refer to a plurality of different second luminescent materials. In embodiments, further luminescent materials may be available.

As further also discussed below, in embodiments also a fifth type of light source may be available. Herein, the term "fifth light source" may especially be used for a solid state light source that is not based on phosphor conversion, i.e. essentially the spectral distribution is determined by the light escaping from the solid state die, and which light source is not within the definitions for the first light source, the second light source, and the third light source. Note that in embodiments the first light source, the second light source, and the third light source, may also not be based on phosphor conversion (though the luminescent material may in embodiments convert part of the light of one or more of the first light source light, the second light source light, and the third light source light). The term "phosphor conversion" especially refers to the fact that the phosphor converts at least part of the light into luminescent material light.

In embodiments, the luminescent material is configured downstream of the first light source, the second light source, and the third light source. Especially, the luminescent material may be configured remote from the first light source, the second light source, and the third light source, i.e. at least not in physical contact therewith.

The terms "upstream" and "downstream" relate to an arrangement of items or features relative to the propagation of the light from a light generating means (here the especially the light source), wherein relative to a first position within a beam of light from the light generating means, a second position in the beam of light closer to the light generating means is "upstream", and a third position within the beam of light further away from the light generating means is "downstream".

In embodiments wherein the first luminescent material and the second luminescent material is available (see also above and below), one or more of the first luminescent material and the second luminescent material, especially both, are configured downstream of the first light source, the second light source, and the third light source. However, in other embodiments the luminescent materials is configured downstream of one or more, but not all, of the light sources selected from the group consisting of the first light source, the second light source, the third light source, and the optional fourth light source. The terms "green light" or "green emission" especially relate to light having a wavelength in the range of about 495-570 nm. The terms "yellow light" or "yellow emission" especially relate to light having a wavelength in the range of about 570-590 nm. The terms "orange light" or "orange emission" especially relate to light having a wavelength in the range of about 590-620 nm. The terms "red light" or "red emission" especially relate to light having a wavelength in the range of about 620-780 nm. The term "pink light" or "pink emission" refers to light having a blue and a red component. The terms "visible", "visible light" or "visible emission" refer to light having a wavelength in the range of about 380-780 nm. For visible light, the terms "radiation" and "light" may be used interchangeably.

The term white light herein, is known to the person skilled in the art. It especially relates to light having a correlated color temperature (CCT) between about 2000 and 20000 K, especially 2700-20000 K, for general lighting especially in the range of about 2700 K and 6500 K, and for backlighting purposes especially in the range of about 7000 K and 20000 K, and especially within about 15 SDCM (standard deviation of color matching) from the BBL (black body locus), especially within about 10 SDCM from the BBL, even more especially within about 5 SDCM from the BBL. Lower CCT's may also be possible. In an embodiment, the lighting device may be configured to provide white light having a correlated color temperature (CCT) between about 1500-20,000 K, such as between about 2000 and 20,000 K, like 1600-10000 K, such as 2000-10,000 K, like 2000-6000 K.

The system further comprises a control system configured to control e.g. one or more of the color point, the color temperature, and the color rendering index (CRI) of the lighting system light. As indicated above, (in operation) the lighting system light comprises one or more of the first light source light, the second light source light, the third light source light, and the luminescent material light, and optionally fourth light source light. Optionally, also fifth light source light may be comprised by the lighting system light. Especially, the lighting system light is controllable, implying that the spectral distribution can be controlled. This can be done by controlling the (relative) contributions of the first light source, the second light source, and the third light source, and optionally other types of light sources.

The term "controlling" and similar terms especially refer at least to determining the behavior or supervising the running of an element. Hence, herein "controlling" and similar terms may e.g. refer to imposing behavior to the element (determining the behavior or supervising the running of an element), etc., such as e.g. measuring, displaying, actuating, opening, shifting, changing temperature, etc. Beyond that, the term "controlling" and similar terms may additionally include monitoring. Hence, the term "controlling" and similar terms may include imposing behavior on an element and also imposing behavior on an element and monitoring the element.

The controlling of the element can be done with a control system. The control system and the element may thus at least temporarily, or permanently, functionally be coupled. The element may comprise the control system. In embodiments, the control system and element may not be physically coupled. Control can be done via wired and/or wireless control. The term "control system" may also refer to a plurality of different control systems, which especially are functionally coupled, and of which e.g. one control system may be a master control system and one or more others may be slave control systems.

In embodiments, the lighting device comprises the control system. In yet further embodiments, the lighting device may comprise a slave control system, and the lighting system comprises a master control system configured to control the slave control system(s) of the lighting device(s). The lighting system may also comprise a plurality of lighting devices, which may all be controlled by the (master) control system.

In embodiments, the lighting system may be configured to provide white lighting system light in a first setting and colored lighting system light in another setting. Alternatively or additionally, the lighting system may also be configured to provide white lighting system light with different correlated color temperatures (and may thus be configured to be used at different settings). Herein, the terms "setting" or "mode" or similar terms may especially refer to the (amount of) power provided to the one or more (solid state) light sources.

In yet further embodiments, the control system may be configured to control the power provided to the one or more (solid state) light sources. Optionally, the control system may comprise a plurality of elements, of which some may be comprised by the lighting system and others may be external from the lighting system (such as a remote user interface, see also below). Optionally, also the power may be included in the lighting system, such as in the case of certain handheld flashlights.

In embodiments, the control system may be configured to control the lighting system light in a controlling mode wherein white lighting system light is provided, wherein the white lighting system light comprises the first light source light, the third light source light, and the luminescent material light, and optionally the second light source light. In yet other embodiments, the control system may be configured to control the lighting system light in a controlling mode wherein white lighting system light is provided, wherein the white lighting system light comprises the first light source light, the second light source light, and the luminescent material light, and optionally the third light source light. Especially, the control of the relative intensities of the first light source light and the second light source light may allow varying one or more optical properties while maintaining one or more other optically properties essentially constant.

In specific embodiments, the luminescent material may comprise (i) a first luminescent material configured to convert part of one or more of the first light source light, the second light source light, and the third light source light into first luminescent material light having an emission with one or more wavelengths selected from the range of 530-590 nm, and (ii) a second luminescent material configured to configured to convert part of one or more of the first light source light, the second light source light, and the third light source light into second luminescent material light, spectrally different from the first luminescent material light, having an emission with one or more wavelengths selected from the range of 590-680 nm.

Preferably, the first luminescent material has an excitation spectrum with a peak maximum, wherein the peak maximum has a wavelength larger than the peak wavelength of the second light source. In an embodiment, the spectral overlap between the excitation spectrum of the first luminescent material and the emission band of the second light source is less than 40%, preferably less than 30%, more preferably less than 20%, even more preferably less than 10%. In an embodiment, the second luminescent material is at least partly excited by the first light source light. In an embodiment, the spectral overlap between the excitation spectrum of the second luminescent material and the emission band of the second light source is at least 30%, preferably at least 40%, more preferably at least 50%. In such embodiments, when decreasing the intensity of the first light source, resulting in a decrease of the white rendering of the light, the reduced activation of the second luminescent material may be compensated by increasing the intensity of the second light source. As a result, one or more other light properties (e.g. color rendering index, color point, color temperature, melanopic daylight equivalent efficiency factor (MDEF)) than white rendering may be kept essentially constant.

In other embodiments, instead of a luminescent material having (substantial) intensity in the red, a separate light source may be applied, not necessarily based on a red emitting luminescent material. Hence, in embodiments the lighting system (or lighting device) may comprise a first luminescent material configured to convert part of one or more of the first light source light, the second light source light, and the third light source light into first luminescent material light having an emission with one or more wavelengths selected from the range of 530-590 nm, and a fifth light source configured to generate fifth light source light, spectrally different from the first light source light, the second light source light, the third light source light, and the luminescent material light, having an emission with one or more wavelengths selected from the range of 590-680 nm.

As indicated above, the lighting system (or device) may be used to generate (white) light with a crisp aspect. To this end, the control system may control the relative intensities of the first light source, the second light source, and the third light source, especially also in relation to the supplemental light in the green and/or yellow, and red.

Especially, the lighting system or lighting device may be used for providing white lighting device light or white lighting system light, especially having a LE (lumen equivalent; see also below) of at least 300 Lm/W. Further, especially such lighting device may be used for providing white lighting system light having a ratio of the deep blue radiation in the range of 400-440 nm to the total radiation in the range of 380-780 nm of $I_{400\text{-}440\ nm}/I_{380\text{-}780\ nm}$ of ≤0.05, especially ≤0.03, such as even more especially ≤0.02, or even lower, such as in the range of 0.001-0.05, like in the range of 0.02-0.002. Hence, in the order of about 0.1-3%, such as about 0.2-2% of the total power in the visible range of 380-780 nm may be the deep blue (in the range of 400-440 nm).

The color rendering (CRI) can also be relatively high, such as at least 80 and/or a R9 of at least 90.

In specific embodiments, the control system may further be adapted to control in a controlling mode one or more of the color point, the color temperature, and the color rendering index of the lighting system light. As will be further explained below, this may e.g. be done in response to one or more of time, a sensor signal, and user input. Hence, the control system may further be adapted to control in a controlling mode one or more of the color point, the color temperature, and the color rendering index of the lighting system light as function of one or more of time, a sensor signal, and user input.

Further, such lighting device may especially be adapted to produce (at a first setting of the lighting device) a ratio (A') of the integral spectral power distribution of light of the wavelength range from 380 to 430 nm to the integral spectral power distribution of the total output light produced by the light emitting module defined by:

$$A' = \left(\int_{380}^{430} (430-\lambda)E(\lambda)d\lambda\right) \Big/ \left(\int_{380}^{780} E(\lambda)d\lambda\right)$$

wherein 0.6≤A'≤3. Such light may herein also be indicated as crisp white light. In embodiments of the invention, A' is equal to, or higher than, 0.6, typically at least 0.8, e.g. 0.8≤A'≤3. In embodiments of the invention, 1≤A'≤2.

In embodiments, however, A' may also be lower than 0.6, such as in the range of smaller than 0.6, but equal to or larger than 0.3. This may be the case when a crisp effect is less relevant, such as under conditions where there is a substantial contribution of daylight. Hence, in a controlling mode, A' may also be selected to be smaller than 0.6, like equal to zero or larger, such as at least 0.3. In general A' will be larger than 0.

In specific embodiments, however, A' may also be larger than 3, such as in the range of larger than 3, like in embodiments up to e.g. 6. Hence, in a controlling mode, A' may also be selected to be larger than 3, like equal to up to about 6, or higher.

Hence, a lighting device may be provided being able to provide white light having a relatively good color rendering, a relatively high CE (conversion efficiency; see also below), a relatively low deep blue contribution, with a relatively high efficiency, with the light having the desired crisp effect. Especially, the lighting device may be used for illuminating an object comprising a fluorescent whitening agent. The white light spectrum generated by the light emitting module may have a color rendering index (CRI) of 80 or 90.

Further, the one or more light sources are especially configured to provide a ratio of the deep blue radiation in the range of 400-440 nm to the total radiation in the range of 400-490 nm of $I_{400\text{-}440\ nm}/I_{400\text{-}490\ nm}$ of ≤0.30, especially ≤0.20, such as even more especially ≤0.15, or even lower, such as ≤0.10, like in the range of 0.05-0.20, like 0.05-0.15. Hence, this ratio especially defines the pump ratio. In the spectral power distribution of the lighting system light, this ratio may be even lower.

As indicated above, in yet further specific embodiments, the control system may be configured to control the power provided to the one or more (solid state) light sources as function of an input signal "user input" of a user interface. This user interface may be integrated in the lighting system, but may also be remote from the lighting system. Hence, the user interface may in embodiments be integrated in the lighting system but may in other embodiments be separate from the lighting system. The user interface may e.g. be a graphical user interface. Further, the user interface may be provided by an App for a Smartphone or other type of android system. Therefore, the invention also provides a computer program product, optionally implemented on a record carrier (storage medium), which when run on a computer executes the method as described herein (see below) and/or can control (the color temperature of the lighting system light of) the lighting system as described herein (as function of the power provided to the one or more (solid state) light sources).

Alternatively or additionally, the control system is configured to control the power provided to the one or more (solid state) light sources as function of one or more of a sensor signal and a timer. To this end, e.g. a timer and/or a sensor may be used. For instance, the timer may be used to switch off after a predetermined time. Further, for instance the sensor may be a motion sensor, configured to sense motion, with the control system configured to switch on the lighting system when the motion sensor senses motion or presence of e.g. a person.

In yet further embodiments, the control system may be further adapted to control in a controlling mode A' of the lighting system light. Especially, in embodiments the control system may be further adapted to control in a controlling mode A' of the lighting system light as function of one or more of time, a sensor signal, and user input.

In specific embodiments, the control system may be configured to keep one or more of the lighting parameters essentially constant, and allow one or more others be variable, such as function of one or more of time, a sensor signal, and user input. Therefore, in specific embodiments the control system may be configured to maintain in a controlling mode one or more of the color point, the color temperature, the color rendering index, and A', within a predetermined range of +/−10%, such as especially +/−5%, of a predetermined value while allowing one or more of the other vary as function of one or more of time, a sensor signal, and user input. For instance, this may be used to keep CRI and color point (and optionally also the correlated color temperature) essentially the same (especially within a predetermined range of +/−10%, such as especially +/−5%, of a predetermined value) while allowing to vary A'. In relation to the color point, x and/or y (or u' and/or v') may vary 10% relative to a predetermined value, such as 5%. In yet further specific embodiments the control system may be configured to maintain in a controlling mode one or more of the color point, the color temperature, the color rendering index, and A', within a predetermined range of +/−4%, such as especially +/−3%, of a predetermined value while allowing one or more of the other vary as function of one or more of time, a sensor signal, and user input.

In yet further specific embodiments, the control system may be configured to allow in a controlling mode A' vary in the range of 0.6-2 as function of one or more of time, a sensor signal, and user input. This mode may especially be suitable to provide the crisp white effect, such as when illuminating an article comprising an optical brightener. When the crisp white effect is not necessary, or not desired, a value smaller than 0.6 may be chosen. This may increase the efficiency.

In embodiments, the control system may be configured to keep one or more, especially two or more of CRI, color point, and CCT, essentially the same (especially within a predetermined range of +/−10%, such as especially +/−5%, of a predetermined value) while allowing to vary A' (as function of one or more of time, a sensor signal, and user input).

In embodiments, the control system may be configured to keep one or more, especially two or more of A', color point, and CCT, essentially the same (especially within a predetermined range of +/−10%, such as especially +/−5%, of a predetermined value) while allowing to vary CRI (as function of one or more of time, a sensor signal, and user input).

In embodiments, the control system may be configured to keep one or more, especially two or more of CRI, A', and CCT, essentially the same (especially within a predetermined range of +/−10%, such as especially +/−5%, of a predetermined value) while allowing to vary the color point (as function of one or more of time, a sensor signal, and user input).

In embodiments, the control system may be configured to keep one or more, especially two or more of CRI, color point, and A', essentially the same (especially within a predetermined range of +/−10%, such as especially +/−5%, of a predetermined value) while allowing to vary CCT (as function of one or more of time, a sensor signal, and user input).

In specific embodiments, the sensor may e.g. comprise an optical sensor. Such sensor may be configured or may be used to determine whether or not a fabric is available. Alternatively or additionally, such sensor may be configured or may be used to determine whether a fabric or other article comprising an optical brighter is available. In specific embodiments, such sensor may be configured or may be used to determine whether a white or dark fabric (such as a black fabric). Further, it may be desirable to control one or more of the lighting parameters in dependence of the availability of other light (not generated by the lighting system (or lighting device), such as artificial light (of another source of light) and/or daylight. The term "dark fabric" may refer to a black fabric, or a dark blue fabric, or a dark brown fabric, or a dark green fabric, etc.

Hence, in embodiments the system (or device) may further comprise a sensor configured to generate the sensor signal in response to one or more of (i) (sensing) light of another source of light and (ii) sensing a fabric. Especially, in embodiments the system (or device) may further comprise a sensor configured to generate the sensor signal in response to one or more of (i) (sensing) light of another source of light and (ii) sensing an article comprising an optical brightener. Alternatively or additionally, in embodiments the system (or device) may further comprise a sensor configured to generate the sensor signal in response to one or more of (i) (sensing) light of another source of light and (ii) sensing a white or dark fabric (such as a black fabric). As indicated above, the light of the outer source of light may refer to light of one or more of another artificial light source and daylight.

Hence, in embodiments the system (or device) may comprise a sensor or may be functionally coupled to a sensor. Further, in embodiments the system (or device) may further comprise a user input device (or may be functionally coupled to a user input device).

Below, some further aspects and/or embodiments of the light sources are discussed in more detail.

The lighting system (or lighting device) may in embodiments comprise the same (or more) number of channels as the number of types of light sources. This may allow a large control of the lighting parameters of the lighting system light (or of the lighting device light). In other embodiments, two or more types of light sources are functionally connected to the same channel. Hence, there may be at least two channels, though there may be less than the total number of different types of light sources. Especially, the first light source, the second light source, and the third light source (and optionally one or more further light sources, such as the fourth light source and/or fifth light source) are functionally connected to different channels.

The term "light source" may refer to a semiconductor light-emitting device, such as a light emitting diode (LEDs), a resonant cavity light emitting diode (RCLED), a vertical cavity laser diode (VCSELs), an edge emitting laser, etc. The term "light source" may also refer to an organic light-emitting diode, such as a passive-matrix (PMOLED) or an active-matrix (AMOLED). In a specific embodiment, the light source comprises a solid state light source (such as a LED or laser diode). In an embodiment, the light source comprises a LED (light emitting diode). The term LED may also refer to a plurality of LEDs. Further, the term "light source" may in embodiments also refer to a so-called chips-on-board (COB) light source. The term "COB" especially refers to LED chips in the form of a semiconductor chip that is neither encased nor connected but directly mounted onto a substrate, such as a PCB. Hence, a plurality of semiconductor light sources may be configured on the same substrate. In embodiments, a COB is a multi LED chip configured together as a single lighting module. The term "light source" may also relate to a plurality of light sources, such as 2-2000 solid state light sources.

The lighting system (or lighting device) may further comprise an optical element, such as one or more of a reflector and a lens, such as a Fresnel lens, configured to shape a beam of lighting system light (or lighting device light). This may especially be useful for creating a spotlight. In specific embodiments, the reflector has an optical axis, wherein in embodiments the reflector is rotational symmetric relative to the optical axis and/or mirror symmetric relative to a plane comprising the optical axis, and wherein the reflector is configured to provide a beam angle ($\alpha$) selected from the range of 5-60°, such as selected from the range of 5-40°, like 12-36°. In alternative (or additional) specific embodiments, the lens, such as a Fresnel lens, has an optical axis, wherein the lens in embodiments is rotational symmetric relative to the optical axis and/or mirror symmetric relative to a plane comprising the optical axis, and wherein the lens is configured to provide a beam angle ($\alpha$) selected from the range of 5-60°, such as selected from the range of 5-40°, like 12-36°. The optical element is not necessarily rotational symmetric; also a square shape or other shapes maybe possible.

The beam has an optical axis. The beam angle may differ between different cross-sections of the beam (wherein the cross-sections include the optical axis). Hence, the phrase "beam angle ($\alpha$) selected from the range of 5-60°" especially indicates that the beam angles in different cross-sections are essentially all selected from the indicated range.

Hence, in embodiments the optical element may be configured to shape a beam of lighting device light having a beam angle ($\alpha$) selected from the range of 5-60°. For instance, a reflector (as optical element) may be configured to provide a beam angle ($\alpha$) selected from the range of 5-60°. In specific embodiments, the optical element may comprise one or more (optical) elements selected from the group consisting of a reflector and a (Fresnel) lens.

The terms "luminescent material" or "first luminescent material" may each independently refer to a plurality of different luminescent materials (each complying with the herein indicated conditions for the respective "luminescent material" or "first luminescent material" or "second luminescent material").

Especially, a luminescent material may comprise a $M_3A_5O_{12}:Ce^{3+}$ (first) luminescent material, wherein M is selected from the group consisting of Sc, Y, Tb, Gd, and Lu, wherein A is selected from the group consisting of Al, Ga, Sc and In.

Preferably, M at least comprises one or more of Y and Lu, and A at least comprises Al and/or Ga, especially substantially only Al. These types of materials may give highest efficiencies. Especially, M consisting of at least 50%, such as especially at least 80% of Y (such as $(Y_{0.9}Lu_{0.05}Ce_{0.05})_3Al_5O_{12}:Ce^{3+}$) appears to provide good results in combination with the second luminescent material.

Embodiments of garnets especially include $M_3A_5O_{12}$ garnets, wherein M comprises at least yttrium and/or lutetium and wherein A comprises at least aluminum. Such garnet may be doped with cerium (Ce), with praseodymium (Pr) or a combination of cerium and praseodymium; especially however with Ce. Especially, A comprises aluminum (Al), however, A may also partly comprise gallium (Ga) and/or scandium (Sc) and/or indium (In), especially up to about 20% of Al, more especially up to about 10% of Al (i.e. the A ions essentially consist of 90 or more mole % of Al and 10 or less mole % of one or more of Ga, Sc and In); A may especially comprise up to about 10% gallium. In another variant, A and 0 may at least partly be replaced by Si and N. The element M may especially be selected from the group consisting of yttrium (Y), gadolinium (Gd), terbium (Tb) and lutetium (Lu). Further, Gd and/or Tb are especially only present up to an amount of about 20% of M. In a specific embodiment, the garnet (second) luminescent material comprises $(Y_{1-x}Lu_x)_3B_5O_{12}:Ce$, wherein x is equal to or larger than 0 and equal to or smaller than 1. The term ":Ce" or ":$Ce^{3+}$", indicates that part of the metal ions (i.e. in the garnets: part of the "M" ions) in the (second) luminescent material is replaced by Ce. For instance, assuming $(Y_{1-x}Lu_x)_3Al_5O_{12}:Ce$, part of Y and/or Lu is replaced by Ce. This notation is known to the person skilled in the art. Ce will replace M in general for not more than 10%; in general, the Ce concentration will especially be in the range of 0.1-4%, especially 0.1-2% (relative to M). Assuming 1% Ce and 10% Y, the full correct formula could be $(Y_{0.1}Lu_{0.89}Ce_{0.01})_3Al_5O_{12}$. Ce in garnets is substantially or only in the trivalent state, as known to the person skilled in the art. The term "YAG" especially refers to M=Y and A=Al; the term "LuAG" especially refers to M=Lu and A=Al.

One of the luminescent materials may especially be configured to absorb at least part of the light source radiation and convert into first luminescent material light (which is green and/or yellow).

Herein, in specific embodiments the (first) luminescent material comprises LuAG and especially emits essentially in the green.

Another luminescent material is especially configured to absorb at least part of the light source radiation and be configured (this absorbed light) into luminescent material light (which is essentially red).

A useful red luminescent material appeared to be Mn(IV) ("tetravalent manganese") type luminescent materials. Hence, in an embodiment the second luminescent material comprises a red luminescent material selected from the group consisting of Mn(IV) luminescent materials, even more especially the second luminescent material comprises a luminescent material of the type $M_2AX_6$ doped with tetravalent manganese, wherein M comprises an alkaline cation, wherein A comprises a tetravalent cation, and wherein X comprises a monovalent anion, at least comprising fluorine (F). For instance, $M_2AX_6$ may comprise $K_{1.5}Rb_{0.5}AX_6$. M relates to monovalent cations, such as selected from the group consisting of potassium (K), rubidium (Rb), lithium (Li), sodium (Na), cesium (Cs) and ammonium ($NH_4^+$), and especially M comprises at least one or more of K and Rb. Preferably, at least 80%, even more preferably at least 90%, such as 95% of M consists of potassium and/or rubidium. The cation A may comprise one or more of silicon (Si) titanium (Ti), germanium (Ge), stannum (Sn) and zinc (Zn). Preferably, at least 80%, even more preferably at least 90%, such as at least 95% of A consists of silicon and/or titanium (not taking into account the partial replacement by $Mn^{4+}$). Especially, M comprises potassium and A comprises titanium. X relates to a monovalent anion, but especially at least comprises fluorine. Other monovalent anions that may optionally be present may be selected from the group consisting of chlorine (Cl), bromine (Br), and iodine (I). Preferably, at least 80%, even more preferably at least 90%, such as 95% of X consists of fluorine. The term "tetravalent manganese" refers to $Mn^{4+}$. This is a well-known luminescent ion. In the formula as indicated above, part of the tetravalent cation A (such as Si) is being replaced by manganese. Hence, $M_2AX_6$ doped with tetravalent manganese may also be indicated as $M_2A_{1-m}Mn_mX_6$. The mole percentage of manganese, i.e. the percentage it replaces the tetravalent cation A will in general be in the range of 0.1-15%, especially 1-12%, i.e. m is in the range of 0.001-0.15, especially in the range of 0.01-0.12. Further embodiments may be derived from WO2013/088313, which is herein incorporated by reference. However, also other red luminescent materials may be applied. Hence, in an embodiment the second luminescent material comprises $M_2AX_6$ doped with tetravalent manganese, wherein M comprises an alkaline cation, wherein A comprises a tetravalent cation, and wherein X comprises a monovalent anion, at least comprising fluorine. Even more especially, wherein M comprises at least one or more of K and Rb, wherein A comprises one or more of Si and Ti, and wherein X=F. An example of a suitable second luminescent material is e.g. $K_2SiF_6$:Mn (5%)(i.e. $K_2Si_{(1-x)}Mn_xF_6$, with x=0.05). Here, M is substantially 100% K, A is substantially 100% Ti, but with a replacement thereof with 5% Mn (thus effectively 95% Ti and 5% Mn), and X is substantially 100% F.

Herein, the second luminescent material is especially indicated as red luminescent material. As indicated above, the second luminescent material light especially has an emission in the range of 620-680 nm. Further, the second luminescent material light especially has one or more emission lines having a full width half maximum (FWHM) at RT of 80 nm or less, such as 60 nm or less, especially 40 nm or less, such as 30 nm or less, like 25 nm or less. Tetravalent manganese shows in the (deep) red a plurality of such lines, with a dominant wavelength in the range of about 620-680 nm. Especially, the red luminescent material may thus especially be a line emitter, like systems that emit due to intra configurational transitions, as is known in the art.

It further appears that such Mn(IV) luminescent materials have a relatively good absorption in the blue and a relatively weak absorption in the deep blue. Hence, in contrast to known broad band emitters, the deep blue radiation may not substantially be absorbed (and optionally converted into red light). In this way, the lighting device is more efficient, and less deep blue intensity is necessary to provide the desired effect. Hence, the deep blue contribution to the total contribution of blue light may be reduced.

Alternatively or additionally, one or more other (third) luminescent materials may be applied.

Further, it appears that an addition of a broad band red may also be beneficial. Hence, in a further embodiment the invention provides a second luminescent material configured to absorb one or more of the light source radiation and configured to provide second luminescent material light with light intensity in the orange and/or red spectral region having a full width half maximum (FWHM) at RT of larger than 40 nm, such as larger than 50 nm, like in the range of 50-100 nm. Hence, in such embodiment the lighting system light at the first setting may also comprise second luminescent material. In embodiments, the lighting system (or device) comprises both (Mg,Sr,Ca)$AlSiN_3$:Eu and $K_2SiF_6$:Mn (5%) as second luminescent materials.

In embodiments, when different (types of) luminescent materials are available, the luminescent materials are in the same layer or in the same converter. However, other configurations may also be possible.

A (second) luminescent material may comprises one or more phosphors selected from the group consisting of divalent europium containing nitride luminescent material or a divalent europium containing oxonitride luminescent material.

A (second) luminescent material may in embodiments comprise one or more materials selected from the group consisting of (Ba,Sr,Ca)S:Eu, (Mg,Sr,Ca)$AlSiN_3$:Eu and $(Ba,Sr,Ca)_2Si_{5-x}Al_xO_xN_{8-x}$:Eu, especially with x in the range of 0-5, even more especially with x in the range of 0-2, even more especially $0<x\leq 0.2$, such as at least 0.02. In these compounds, europium (Eu) is substantially or only divalent, and replaces one or more of the indicated divalent cations. In general, Eu will not be present in amounts larger than 10% of the cation, especially in the range of about 0.5-10%, more especially in the range of about 0.5-5% relative to the cation(s) it replaces. The term ":Eu" or ":$Eu^{2+}$", indicates that part of the metal ions is replaced by Eu (in these examples by $Eu^{2+}$). For instance, assuming 2% Eu in $CaAlSiN_3$:Eu, the correct formula could be $(Co_{0.98}Eu_{0.02})AlSiN_3$. Divalent europium will in general replace divalent cations, such as the above divalent alkaline earth cations, especially Ca, Sr or Ba. The material (Ba,Sr,Ca)S:Eu can also be indicated as MS:Eu, wherein M is one or more elements selected from the group consisting of barium (Ba), strontium (Sr) and calcium (Ca); especially, M comprises in this compound calcium or strontium, or calcium and strontium, more especially calcium. Here, Eu is introduced and replaces at least part of M (i.e. one or more of Ba, Sr, and Ca). Further, the material $(Ba,Sr,Ca)_2Si_{5-x}Al_xO_xN_{8-x}$:Eu can also be indicated as $M_2Si_{5-x}Al_xO_xN_{8-x}$:Eu, wherein M is one or more elements selected from the group consisting of barium (Ba), strontium (Sr) and calcium (Ca); especially, M comprises in this compound Sr and/or Ba. In a further specific embodiment, M consists of Sr and/or Ba (not taking into account the presence of Eu), especially 50-100%, especially 50-90% Ba and 50-0%, especially 50-10% Sr, such as $Ba_{1.5}Sr_{0.5}Si_5N_8$:Eu, (i.e. 75% Ba; 25% Sr). Here, Eu is introduced and replaces at least part of M i.e. one or more of Ba, Sr, and Ca). Likewise, the material (Ba,Sr,Ca)$AlSiN_3$:Eu can also be indicated as $MAlSiN_3$:Eu wherein M is one or more elements selected from the group consisting of barium $(Ba)_5$ strontium (Sr) and calcium (Ca); especially, M comprises in this compound calcium or strontium, or calcium and strontium, more especially calcium. Here, Eu is introduced and replaces at least part of M (i.e. one or more of Ba, Sr, and Ca).

Especially, in embodiments the second luminescent material comprises (Ca,Sr,Mg)$AlSiN_3$:Eu, preferably $CaAlSiN_3$:Eu. Further, in embodiments the second luminescent material comprises $(Ca,Sr,Ba)_2Si_5N_8$:Eu, preferably $(Sr,Ba)_2Si_5N_8$:Eu.

The terms "(Ca,Sr,Ba)" indicate that the corresponding cation may be occupied by calcium, strontium or barium. It also indicates that in such material corresponding cation sites may be occupied with cations selected from the group consisting of calcium, strontium and barium. Thus, the material may for instance comprise calcium and strontium, or only strontium, etc.

Hence, in an embodiment the second luminescent material may further comprise $M_2Si_5N_8:Eu^{2+}$, wherein M is selected from the group consisting of Ca, Sr and Ba, even more especially wherein M is selected from the group consisting of Sr and Ba. In yet another embodiment, which may be combined with the former, the second luminescent material may further comprise $MSiAlN_3:Eu^{2+}$, wherein M is selected from the group consisting of Ca, Sr and Ba, even more especially wherein M is selected from the group consisting of Sr and Ba.

Hence, in embodiments a luminescent material comprises a divalent europium comprising luminescent material, such as a divalent europium comprising silicate or a divalent europium comprising nitride, or a divalent europium comprising oxynitride, or a divalent europium comprising halide, or a divalent europium comprising oxyhalide, or a divalent europium comprising sulfide, or a divalent europium comprising oxysulfide, or a divalent europium comprising thiogallate.

In embodiments, a luminescent material comprises one or more of $Ca_8Mg(SiO_4)_4Cl_2:Eu^{2+}$ and $Ca_8Zn(SiO_4)_4Cl_2:Eu^{2+}$ (such as described by S. Okamoto and H. Yamamoto, Electrochemical and solid-state letters, 12, (12) J112-J115 (2009)). In further embodiments, the first luminescent material comprises a β-SiAlON:$Eu^{2+}$ based green emitting phosphor, especially having the formula $Eu_x(A1)_{6-z}(A2)_zO_yN_{8-z}(A3)_{2(x+z-y)}$, where $0<z\leq 4.2$; $0\leq y\leq z$; $0<x\leq 0.1$; A1 is Si, C, Ge, and/or Sn; A2 comprises one or more of Al, B, Ga, and In; A3 comprises one or more of F, Cl, Br, and I. The new set of compounds described by $Eu_x(A1)_{6-z}(A2)_zO_yN_{8-z}(A3)_{2(x+z-y)}$ have the same structure as 1β-$Si_3N_4$. Both elements A1 and A2 reside on Si sites, and both O and N occupy the nitrogen sites of the β-$Si_3N_4$ crystal structure. A molar quantity (z−y) of the $A3^-$ anion (defined as a halogen) reside on nitrogen sites. See further e.g.: Synthesis and Photoluminescence Properties of β-sialon:$Eu^{2+}$($Si_{6-z}Al_zO_zN_{8-z}$:$Eu^{2+}$), A Promising Green Oxynitride Phosphor for White Light-Emitting Diodes, R.-J. Xiez, N. Hirosaki, H.-L. Li, Y. Q. Li and M. Mitomo, J. Electrochem. Soc. 2007 volume 154, issue 10, J314-J319.

Alternatively or additionally, one or more of the luminescent materials may comprise luminescent quantum structures, such as quantum dots (including dots, rods, multipods, etc.).

To further improve the white appearance the color point of the light emitting module according to embodiments of the invention may be tuned to lie below the black body line (BBL), in particular for low correlated color temperatures, CCTs (typically 4000 K or less).

It has been established an object appears whiter either if it appears brighter, or if it appears achromatic or slightly chromatic with a blue tint. Hence, a bluish color point is perceived as more white than a color point that lies on the black body line (BBL). It is therefore possible to obtain "crisp" white light by tuning the color point of a light source far below the BBL by addition of normal blue. This may however result in a color point outside the ANSI (American National Standards Institute) color space, which defines acceptable variations for an LED light source of a determined color temperature (e.g. 3000 K), also referred to as "ANSI bins". However, the present inventors have found that by adding short wavelength blue light according to the invention rather than normal blue, the final color point may again be located within the ANSI space, and still give excellent white rendering, including "crisp white". It may be noted that the addition of the short wavelength blue is not particularly meant to increase the CRI, but to provide a desired "crisp white" effect.

In embodiments of the invention, the light generated by the light emitting module may have a color point in the CIE 1931 chromaticity diagram or the 1976 CIE chromaticity diagram which lies on the black body line.

In embodiments of the invention, the light generated by the light emitting module may have a color point in the CIE 1931 chromaticity diagram or the 1976 CIE chromaticity diagram which lies below or slightly below the black body line. When the color point of the light generated by the light emitting module is tuned at little bit below the black body line (this further improves the white appearance of an illuminated white object.

In some embodiments, the, the light generated by the light emitting module may have a color point in the CIE 1931 chromaticity diagram or the 1976 CIE chromaticity diagram which lies within the ANSI color space for the respective color temperature of the light emitting module.

The term chromaticity is used to identify the color of a light source regardless of its brightness or luminance. In particular, the chromaticity of a light source can be represented by chromaticity coordinates, or color points in the 1931 CIE Chromaticity Diagram or the 1976 CIE Chromaticity Diagram (Commission International de l'Eclairage). The color temperature of a light source is defined in terms of an ideal, purely thermal light source also known as a blackbody radiator, whose light spectrum has the same chromaticity as that of the light source. The color temperature is measured in Kelvin (K). The so called black body locus (or line) is the path or line that the color of an incandescent black body would take in a particular chromaticity space as the blackbody temperature changes.

The phrase "at a first setting of the lighting system" and similar phrases indicate that the lighting device at least includes a single setting such as "on". Hence, the invention also provides lighting devices which have (substantially) no tunability in intensity except for "on" and "off".

Further, in other embodiments the lighting device or lighting system may include a plurality of (first) settings wherein substantially the ratio between the deep blue radiation and blue light, stays the same, i.e. the light source radiation shows an emission spectrum that may not substantially change with changing power. In these embodiments, the lighting system light may have substantially the same spectral characteristics over the entire power range.

The lighting device or lighting system may be part of or may be applied in e.g. office lighting systems, household application systems, shop lighting systems, home lighting systems, accent lighting systems, spot lighting systems, theater lighting systems, fiber-optics application systems, projection systems, self-lit display systems, pixelated display systems, segmented display systems, warning sign systems, medical lighting application systems, indicator sign systems, decorative lighting systems, portable systems, automotive applications, green house lighting systems, horticulture lighting, or LCD backlighting.

Especially however, a lighting device according to embodiments of the invention may advantageously be used for illuminating objects and articles comprising a fluorescent whitening agent (FWA).

The name "fluorescent whitening agents" generally denotes chemical substances that upon excitation by UV light (or deep blue radiation) produce blue fluorescence usually with a peak at 445 nm. Fluorescent whitening agents are added to many products, for example paper, fabrics and plastics, in order to improve the white appearance. However, the present inventors have found that fluorescent whitening agents are also susceptible of excitation by short wavelength blue light, which leads to emission of regular blue light, thus contributing to improving the white impression of the illuminated material. In particular, light having a wavelength of 440 nm or lower, especially 420 nm or lower, can excite fluorescent whitening agents. In embodiments of the invention, a second light emitting diode having an emission intensity averaged wavelength maximum in the range of from 400 to 440 nm may produce a sufficient intensity of light of ≤420 nm to effectively excite a fluorescent whitening agent.

A desirable "crisp white" effect may be represented by the difference (v' shift, Δv' as seen in the 1976 CIE diagram) in color point of the light emitted/reflected by an object containing FWA compared to the light emitted by the light source used for illuminating said object. When the color point of the emitted/reflected light (P2) is shifted further below the black body line compared to the color point of the light (P1) emitted by the light source, this may provide a crisp white effect. In order to provide a desired improvement in white rendition and a "crisp white" effect, a Δv' of at least −0.002 (−Δv'≥0.002) may be sufficient, in particular where the color point of the light source is already below the BBL. However, depending on the color point of the light source, a larger v' shift, e.g. a Δv' of at least −0.005, may be desirable.

The inventors have found that the "crisp white" effect (e.g., a Δv' of −0.005) obtained when illuminating an object containing a fluorescent whitening agent, using a lighting device according to embodiments of the invention, is dependent on the intensity ratio of the "deep" blue light (e.g. 380-430 nm) to the total spectrum emitted by the lighting device.

In yet a further aspect, the invention also provides a method of lighting with lighting system light or lighting device light, such as obtained with the lighting system or lighting device, respectively, described herein, wherein in specific embodiments the lighting system light or lighting device light is controlled as function of one or more of time, a sensor signal, and user input. Especially, in embodiments one or more of the color point, the color temperature, the color rendering index, and A', are controlled. Even more especially, one or more of the color point, the color temperature, the color rendering index, and A', are controlled within a predetermined range of +/−10%, such as +/−5%, of a (respective) predetermined value while allowing one or more of the other vary as function of one or more of time, a sensor signal, and user input. The method may be applied in or for retail, tailors, print proofing, quality control, interior design.

BRIEF DESCRIPTION OF THE DRAWINGS

Embodiments of the invention will now be described, by way of example only, with reference to the accompanying schematic drawings in which corresponding reference symbols indicate corresponding parts, and in which.

Figure 1:
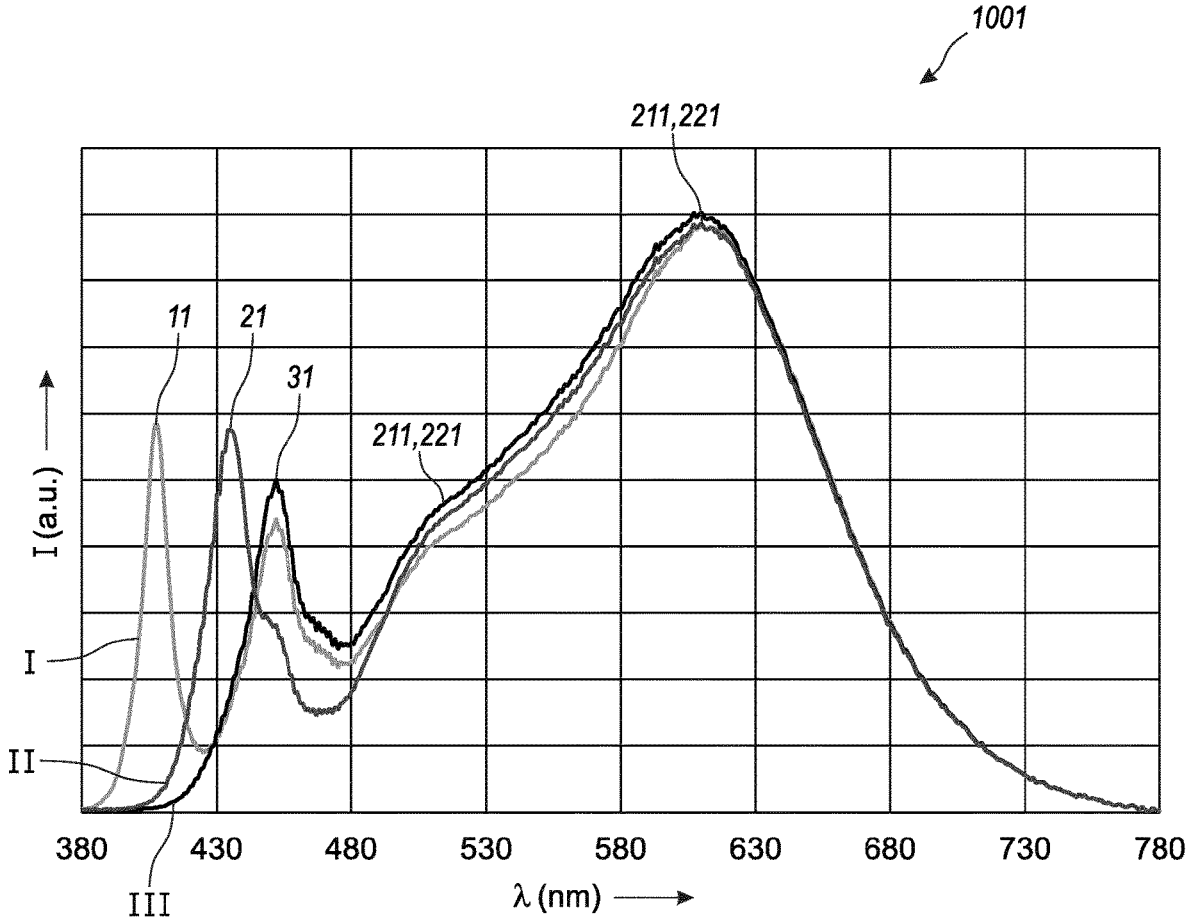
FIG. 1 shows three spectral distributions in line with table 1 below.

The schematic drawings are not necessarily on scale.

DETAILED DESCRIPTION OF THE EMBODIMENTS

Amongst others, the current invention addresses the issue of the tunability of light that should provide in specific applications a crisp effect. Especially in retail, this is desirable, without compromising other quality parameters like CRI and chromaticity. Amongst others, in embodiments the invention provides a lighting system (or light emitting device) that comprises (i) at least one light source, and (ii) at least one (programmed) controller, where the controller is configured to vary the spectral composition of the light output of the system, in such a way that A' (the (weighted) power between 400 nm and 430 nm divided by the power between 380 nm and 780 nm) can be varied while keeping CRI, CCT and total light output constant.

In an example, the user may adjust the amount of crisp (A') of the light system from 0 to 0.3 6 when white fashion is added to the display in the shop. In another example, the user may adjust the amount of crispiness of the light system from 0.3 6 to 01.65 in the shopping window. The shopping window may be a special segment of the shop, since here there may be a contribution of daylight, which also has an A' higher than 0. Hence, to let the items stand out even more, the retailer can increase the amount of crisp.

The variation of A' while keeping CRI and chromaticity constant can be achieved by e.g. a 3-channel system where each channel controls the amount of specific blue1 (violet, PWL<420 nm), blue2 (~450 nm) and blue3 (~430 nm). Especially to maintain CRI and chromaticity constant (when desired in some control modes), the addition of blue1 of 430 nm may be a prerequisite, since it does not activate the yellow phosphor but only the red phosphor. Decreasing crisp (lower current through the 405 nm string) may also lead to a green shift of the spectrum (some of the violet light is used to excite the red phosphor). To compensate the color point shift, the current through the 430 nm LEDs could be increased (430 nm may essentially not be absorbed by the green (LuAG) phosphor, but efficiently absorbed by the red phosphor (of the type $(Mg,Ba,Sr,Ca)AlSiN_3:Eu$). This is visualized below with relating quality parameters (see also FIG. 1):

TABLE 1 data on three spectral distributions (see also FIG. 1)

| | Crisp White | dimming 405 nm | Adding 430 nm |
|---|---|---|---|
| Spectral distribution | I | III | II |
| CIE u' | 0.249 | 0.243 | 0.246 |
| CIE v' | 0.516 | 0.518 | 0.515 |
| CCT | 3074 | 3238 | 3163 |
| A' | 1.3 | 0.1 | 0.2 |
| CRI | 90 | 89 | 87 |
| R9 | 38 | 33 | 31 |

Note that the values of the color point (here CIE u' and CIE v'), the color temperature (CCT), and the color rendering index (CRI) differ less than 3% of an average value, while changing A' from about 0.1 to 1.3, which is a large variation.

Note that the principle of the invention may be irrespective of the color matching function chosen for determination of the color point.

As can be seen in FIG. 1, the spectral distribution I is based on the first light source light 11, the third light source light 31 and the luminescent material light 201 (more in detail two different contributions 211 and 221 of different luminescent materials); the spectral distribution I is based on the second light source light 21, the third light source light 31, and the luminescent material light 201 (more in detail two different contributions 211 and 221 of different luminescent materials); spectral distribution III is based on the third light source light 31 and the luminescent material light 201 (more in detail two different contributions 211 and 221 of different luminescent materials).

Potential application areas can be identified may essentially be all areas where there exists a need to be able to identify various shades of whites are potential application areas, e.g. retail, tailors, print proofing, quality control, interior design, etc. Further, since the current invention is a more optimal approximation of daylight than most other existing LED solutions, the invention may be applicable in situations where a high color fidelity (as compared to daylight) is wanted.

Figure 2:
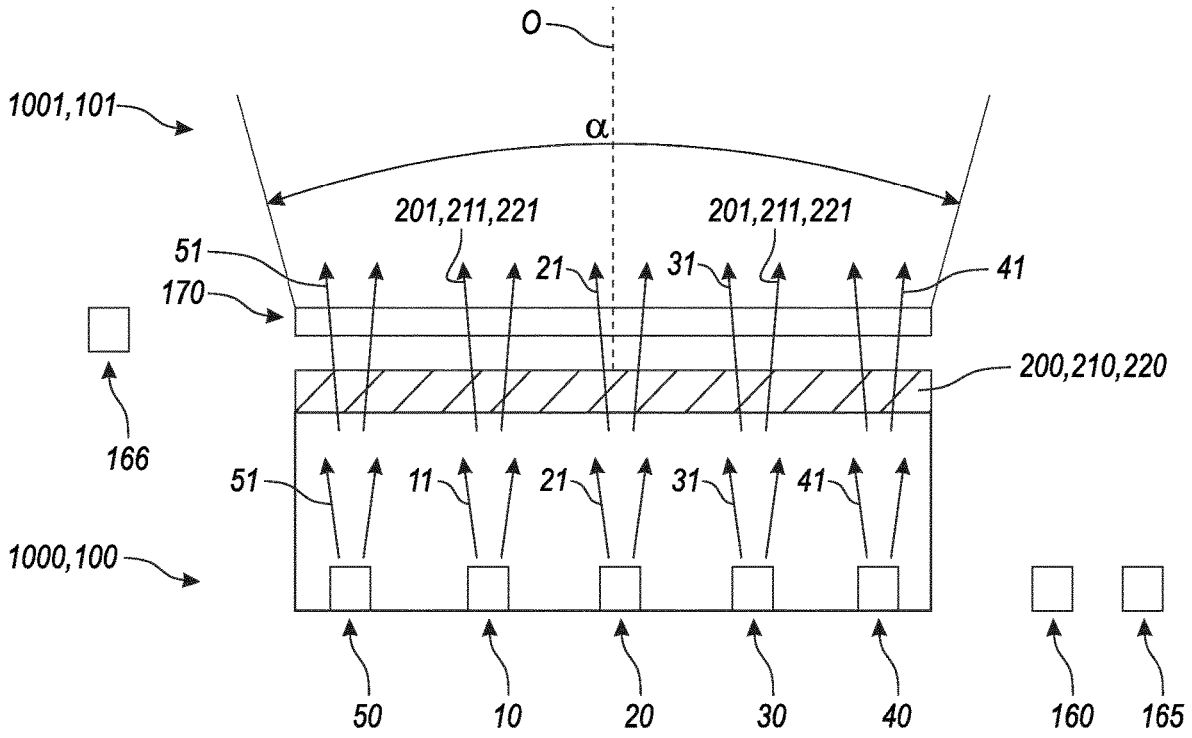
FIG. 2 schematically depicts an embodiment of the lighting system (or lighting device) as described herein.

FIG. 2 schematically depicts an embodiment of a lighting system 1000 configured to provide lighting system light 1001.

Amongst others, the lighting system 1000 comprises a first light source 10 configured to generate first light source light 11 having an emission band with a peak wavelength selected from the range of 380-420 nm. The lighting system 1000 also comprises a second light source 20 configured to generate second light source light 21, spectrally different from the first light source light 11, having an emission band with a peak wavelength selected from the range of 425-440 nm. The lighting system 1000 also comprises a third light source 30 configured to generate third light source light 31, spectrally different from the first light source light 11 and from the second light source light 21, having an emission band with a peak wavelength selected from the range of 445-465 nm. The lighting system 1000 also comprises a luminescent material 200 configured to convert part of one or more of the first light source light 11, the second light source light 21, the third light source light 31, and optional fourth light source light 41 of an optional fourth light source 40, into luminescent material light 201 having an emission with one or more emission wavelengths selected from the range of 530-700 nm. Yet further, the lighting system 1000 also comprises a control system 160 configured to control the lighting system light 1001, wherein the lighting system light 1001 comprises one or more of the first light source light 11, the second light source light 21, the third light source light 31, and the luminescent material light 201.

The lighting system 1000 may further comprise a sensor 166, such as an optical sensor, like a daylight sensor, etc. The lighting system 1000 may also comprise a plurality of such sensors 166. The lighting system 1000 may also comprise a user input device 165, which may be comprised by the control system 160 or may be functionally coupled thereto.

In embodiments, the luminescent material 200 comprises a first luminescent material 210 configured to convert part of one or more of the first light source light 11, the second light source light 21, and the third light source light 31 into first luminescent material light 211 having an emission with one or more wavelengths selected from the range of 530-590 nm, and a second luminescent material 220 configured to configured to convert part of one or more of the first light source light 11, the second light source light 21, and the third light source light 31 into second luminescent material light 221, spectrally different from the first luminescent material light 211, having an emission with one or more wavelengths selected from the range of 590-680 nm, see also FIG. 1.

In the schematically depicted embodiment of the lighting system 1000, the first luminescent material 210 and the second luminescent material 220 are configured downstream of the first light source 10, the second light source 20, and the third light source 30 (and remote from these light sources 10,20,30). Hence, here (all) luminescent material 200 is configured downstream of the first light source 10, the second light source 20, and the third light source 30. Other configurations are, however, also possible.

Alternatively or additionally, the lighting system 1000 may comprise a fifth light source 50 configured to generate fifth light source light 51, spectrally different from the first light source light 11, the second light source light 21, the third light source light 31, and the luminescent material light 201, having an emission with one or more wavelengths selected from the range of 590-680 nm. This may be a non-phosphor converted solid state light source, such as a red LED.

The schematically depicted embodiment of the lighting system 1000 may further comprise an optical element 170, such as a reflector or lens, configured to shape a beam of lighting system light 1001, and wherein the optical element 170 is configured to provide a beam angle $\alpha$ selected from the range of 5-60°. Reference O indicates an optical axis of the beam.

Hence, effectively FIG. 2 also schematically depicts a lighting device 100 configured to provide lighting device light 101, the lighting device 100 comprising (i) a first light source 10 configured to generate first light source light 11 having an emission band with a peak wavelength selected from the range of 380-420 nm; (ii) a second light source 20 configured to generate second light source light 21, spectrally different from the first light source light 11, having an emission band with a peak wavelength selected from the range of 425-440 nm; (iii) a third light source 30 configured to generate third light source light 31, spectrally different from the first light source light 11 and from the second light source light 21, having an emission band with a peak wavelength selected from the range of 445-465 nm; (iv) a luminescent material 200 configured to convert part of one or more of the first light source light 11, the second light source light 21, the third light source light 31, and optional fourth light source light 41 of an optional fourth light source 40, into luminescent material light 201 having an emission with one or more emission wavelengths selected from the range of 530-700 nm; and optionally (v) an optical element 170 configured to shape a beam of lighting device light 101 having a beam angle $\alpha$ selected from the range of 5-60°, wherein the lighting device light 101 comprises one or more of the first light source light 11, the second light source light 21, the third light source light 31, and the luminescent material light 201. Such lighting device 100 may comprise the control system 160 or may be functionally coupled to it.

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Furthermore, some of the features can form the basis for one or more divisional applications.

The invention claimed is:

1. A lighting system configured to provide lighting system light, the lighting system comprising:

a first light source configured to generate first light source light having an emission band with a peak wavelength selected from the range of 380-420 nm;

a second light source configured to generate second light source light, spectrally different from the first light source light, having an emission band with a peak wavelength selected from the range of 425-440 nm;

a third light source configured to generate third light source light, spectrally different from the first light source light and from the second light source light, having an emission band with a peak wavelength selected from the range of 445-465 nm;

a luminescent material configured to convert part of one or more of the first light source light, the second light source light and the third light source light into luminescent material light having an emission with one or more emission wavelengths selected from the range of 530-700 nm; and a control system configured to control the lighting system light in one or more controlling modes wherein white lighting system light is provided, wherein the white lighting system light comprises the first light source light, the luminescent material light, and one or more of the second light source light and the third light source light, wherein the control system is further adapted to produce a ratio A' of the integral spectral power distribution of lighting system light of the wavelength range from 380 to 430 nm to the integral spectral power distribution of the total output of the lighting device light defined by:

$$A' = \left(\int_{380}^{430} (430-\lambda)E(\lambda)d\lambda\right) \Big/ \left(\int_{380}^{780} E(\lambda)d\lambda\right)$$

wherein E(λ) is the integral spectral power distribution and λ, the wavelength, wherein $0.6 \le A' \le 3$, and wherein the control system is configured to maintain one or more of the color point, the color temperature, and the color rendering index of the lighting system light, within predetermined ranges of +/−10% of predetermined values, respectively, while allowing A' to vary as function of one or more of time, a sensor signal, and user input, by controlling the relative contributions of the first light source, the second light source, and the third light source.

2. The lighting system according to claim 1, wherein the lighting system further comprises a fourth light source configured to generate fourth light source light having an emission band with one or more wavelengths selected from the range of 590-680 nm.

3. The lighting system according to claim 1, wherein the luminescent material comprises (i) a first luminescent material configured to convert part of one or more of the first light source light, the second light source light, and the third light source light into first luminescent material light having an emission with one or more wavelengths selected from the range of 530-590 nm, and (ii) a second luminescent material configured to configured to convert part of one or more of the first light source light, the second light source light, and the third light source light into second luminescent material light, spectrally different from the first luminescent material light, having an emission with one or more wavelengths selected from the range of 590-680 nm.

4. The lighting system according to claim 3, wherein the first luminescent material and the second luminescent material are configured downstream of the first light source, the second light source, and the third light source.

5. The lighting system according to claim 1, wherein the first luminescent material having an excitation spectrum with a peak maximum, wherein the peak maximum has a wavelength larger than the peak wavelength of the second light source.

6. The lighting system according to claim 1, comprising a first luminescent material configured to convert part of one or more of the first light source light, the second light source light, and the third light source light into first luminescent material light having an emission with one or more wavelengths selected from the range of 530-590 nm, and a fifth light source configured to generate fifth light source light, spectrally different from the first light source light, the second light source light, the third light source light, and the luminescent material light, having an emission with one or more wavelengths selected from the range of 590-680 nm.

7. The lighting system according to claim 1, wherein the spectral overlap between the excitation spectrum of the first luminescent material and the emission band of the second light source is less than 30%, preferably less than 20%.

8. The lighting system according to claim 7, wherein the spectral overlap between the excitation spectrum of the second luminescent material and the emission band of the second light source is at least 30%.

9. The lighting system according to claim 1, wherein the control system is further configured to maintain in a controlling mode one or more of the color point, the color temperature and the color rendering index, within a predetermined range of +/−5% of a predetermined value while allowing one or more of the other to vary as function of one or more of time, a sensor signal, and user input.

10. The lighting system according to claim 1, wherein the control system is configured to allow A' to vary in the range of 0.6-2.

11. The lighting system according to claim 10, wherein the control system is configured to allow A' to vary in the range of 0.6-1.

12. The lighting system according to claim 1, further comprising a sensor configured to generate the sensor signal in response to one or more of (i) light of another source of light and (ii) sensing an article comprising an optical brightener.

13. The lighting system according to claim 1, further comprising a user input device.

14. The lighting system according to claim 1, further comprising an optical element configured to shape a beam of lighting system light, and wherein the optical element is configured to provide a beam angle ($\alpha$) selected from the range of 5-60°.

15. The lighting system according to claim 1, wherein the optical element comprises one or more elements selected from the group consisting of a reflector and a (Fresnel) lens.

* * * * *